US005381722A

United States Patent [19]

Begneu

[11] Patent Number: 5,381,722

[45] Date of Patent: Jan. 17, 1995

[54] LIQUID PROPELLANT WEAPON

[75] Inventor: Michel Begneu, Bourges, France

[73] Assignee: Giat Industries, Versailles, France

[21] Appl. No.: 144,522

[22] Filed: Nov. 2, 1993

[30] Foreign Application Priority Data

Nov. 2, 1992 [FR] France ..... 92 13098

[51] Int. Cl.[6] ..... F41A 1/04

[52] U.S. Cl. ..... 89/7

[58] Field of Search ..... 89/7, 8

[56] References Cited

U.S. PATENT DOCUMENTS

| | | | |
|---|---|---|---|
| 4,050,348 | 9/1977 | Graham | 89/7 |
| 4,336,741 | 6/1982 | Baines | 89/7 |
| 4,341,147 | 7/1982 | Mayer | 89/7 |
| 4,376,406 | 3/1983 | Black | 89/7 |
| 4,523,508 | 6/1985 | Mayer et al. | 89/7 |
| 4,711,153 | 12/1987 | Bulman | 89/7 |
| 4,972,777 | 11/1990 | Algera | 89/7 |
| 4,993,310 | 2/1991 | Sackenreuter et al. | 89/7 |
| 5,063,825 | 11/1991 | Nordmann et al. | 89/7 |
| 5,149,907 | 9/1992 | Thiesen | 89/7 |

FOREIGN PATENT DOCUMENTS 2666641 3/1992 France .

*Primary Examiner*—David Brown
*Attorney, Agent, or Firm*—Oliff & Berridge

[57] ABSTRACT

A liquid-propellant weapon includes an injection system composed of several variable-volume reservoirs in each of which a piston is translationally freely mounted. The reservoirs are made in an annular body mounted around a barrel of the weapon. Each reservoir communicates with a combustion chamber by an inlet channel to cause displacement of the piston by the pressure of the combustion gases in the chamber and by an outlet channel to inject the propellant agent under pressure inside the chamber as a result of the displacement of the piston.

17 Claims, 4 Drawing Sheets

LIQUID PROPELLANT WEAPON

BACKGROUND OF THE INVENTION

The present invention relates to a liquid-propellant weapon of the type having a system for injecting a liquid propellant agent into a combustion chamber delimited between a projectile loaded into the barrel of the weapon and a breechblock that closes off the rear end of the barrel. The injection system includes at least one reservoir communicating with the chamber and containing the propellant agent, a piston movable inside the reservoir, and a device that initiates combustion of a small quantity of propellant agent injected directly into the chamber. The injection system uses the pressure of the combustion gases in the chamber to cause displacement of the piston and bring about injection of the propellant agent stored in the reservoir into the chamber.

By comparison with a powder weapon, a liquid-propellant weapon has in particular the advantage of allowing continuous adjustment of the length of the projectile trajectory as a function of the volume of propellant agent injected into the chamber, which volume can be precisely defined. In addition, a liquid-propellant weapon allows for better distribution of the pressure exerted on the projectile during its ballistic phase inside the barrel.

SUMMARY OF THE INVENTION

A goal of the invention is to provide a liquid-propellant weapon that uses the pressure of the combustion gases to inject the propellant agent into the chamber in order to increase the velocity of the projectile as it leaves the barrel.

For this purpose, the invention proposes a liquid-propellant weapon of the aforesaid type, wherein the injection system includes several reservoirs with variable volumes, in each of which a piston is slidably mounted. The reservoirs are formed in an annular body mounted around the barrel, each reservoir communicating with the chamber by an inlet channel to allow the pressure of the combustion gases to cause displacement of the piston. The injection system further includes an outlet channel to inject the propellant agent under pressure into the chamber as a result of displacement of the piston, and a pressure-controlled valve accommodated inside each outlet channel to allow passage of the propellant agent when the pressure in the reservoir becomes higher than the pressure in the combustion chamber.

According to another characteristic of the invention, the body of the injection system is provided with a series of first lengthwise ducts extending parallel to the barrel axis. A variable-volume reservoir is defined inside each duct between two bottom walls constituted respectively by a plug, which seals off one end of the duct, and by a cylindrical element axially adjustable inside the duct, which sealably closes the other end of the duct.

According to another characteristic of the invention, each outlet channel connected between a reservoir and the chamber is made in the body of the injection system and is constituted by a second lengthwise duct extending parallel to the barrel axis, by a linking duct between the reservoir and the second duct, and by a radial linking duct that traverses the barrel wall to cause the chamber to communicate with the second lengthwise duct.

According to one embodiment of the invention, the first lengthwise ducts in which the reservoirs are formed and the second lengthwise ducts that cause these reservoirs to communicate with the chamber are distributed essentially evenly around the barrel, the second ducts being interposed between the first ducts.

According to yet another characteristic of the invention, the valve accommodated in each outlet channel comprises an obstructor formed of a tubular element of which one front end face is closed by a bottom wall provided with a central aperture, the tubular element being centered and slidably mounted, in a sealed manner, in the outlet channel, a piston centered and slidably mounted in a sealed manner inside each obstructor, the piston resting on a rod that is the extension of a plug closing off one open end of the second associated lengthwise duct, and a return spring urging the bottom wall of the obstructor against an annular seat machined in the body of the injection system in the area of the outlet channel located at the intersection of the second lengthwise duct and the radial duct, which causes the second duct to communicate with the combustion chamber.

In general, when the obstructor of each valve is resting on its seat, it closes the passage section between the second lengthwise duct and the radial duct of the associated outlet channel, and, according to another characteristic of the invention, a variable-volume chamber is delimited inside each obstructor between its bottom wall and its piston, the chamber communicating with the second lengthwise duct by the central aperture in the bottom wall of the obstructor. The chamber has a cross section smaller than that of the outlet channel so that the pressure of the propellant agent is exerted on both faces of the bottom wall of the obstructor when the valve is closed.

Thus, the return force of the valve spring necessary to keep the latter closed must only be greater than the difference between the opposite forces exerted by the pressure of the propellant agent on both faces of the bottom wall of the obstructor, thus limiting the return force of the spring which is necessary for holding the valve in the closed position before injection of the propellant agent into the chamber.

According to still another characteristic of the invention, the cylindrical element forming the bottom, adjustable in the axial position of each reservoir, is screwed inside a first associated duct and is displaceable by a mechanism including a fixed sleeve accommodated in the body of the injection system and made rotationally integral therewith by at least one key, the sleeve being driven rotationally by a drive element.

Finally, according to yet another characteristic of the invention, a damping device is provided inside each reservoir to slow down the piston at the end of its path.

This damping device includes in particular an axial stop or tip that is designed to project to a greater or lesser degree inside the associated reservoir through the cylindrical element, which forms the adjustable bottom of the reservoir, and a recess provided at the front face of the piston and designed to fit around the tip at the end of the piston path to slow down the piston by a lamination effect of the propellant agent between the outer diameter of the tip and the diameter of the recess.

In general, the position of the tip is adjusted so that the more the volume of the reservoir is increased, and the more the tip extends inside the reservoir, and conversely the more this volume is decreased, the more the tip retracts.

According to one advantageous embodiment, each mechanism for adjusting the axial position of the movable reservoir bottom of each reservoir also simultaneously ensuring positioning of the associated tip.

BRIEF DESCRIPTION OF THE DRAWINGS

Other advantages, characteristics, and details of the invention will emerge from the explanatory description hereinbelow referring to the attached drawings provided only as examples and wherein.

DETAILED DESCRIPTION OF PREFERRED EMBODIMENTS

Figure 1:
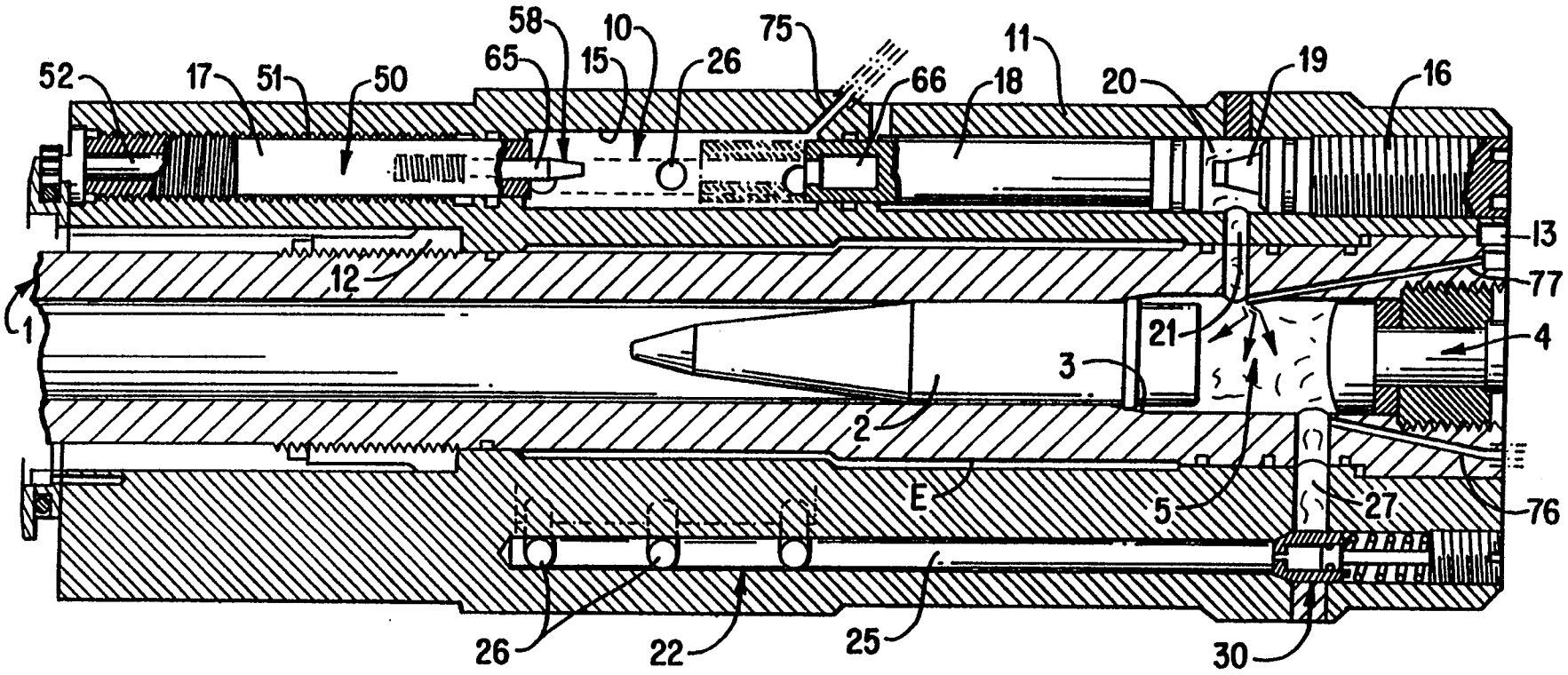
FIG. 1 is a partial lengthwise cross section through a liquid-propellant weapon with an injection system according to the invention, the system being shown in the initial status.

Referring to FIG. 1, a barrel 1 of a medium-or large-caliber liquid-propellant weapon is shown, with a projectile 2 loaded into barrel 1 at the level of a forcing cone 3, in a known manner.

The rear end of barrel 1 is sealed by a breechblock 4. A combustion chamber 5 is delimited in barrel 1 between projectile 2 and breechblock 4 in the closed position of breechblock 4.

The liquid-propellant weapon is equipped with an injection system according to the invention to inject under pressure, into chamber 5, a propellant agent such as an ergol in the liquid or gel form, stored in several reservoirs 10 with variable volumes, disposed around barrel 1.

According to one embodiment of the invention, illustrated in the various figures, the injection system comprises an annular body 11 mounted around barrel 1 of the weapon. Body 11 is centered and attached to weapon 1 by means of a nut 12 and a key 13, for example.

First lengthwise ducts 15 are provided in body 11, parallel to the axis of barrel 1. A variable-volume reservoir 10 is defined in each duct 15 between two bottoms 16 and 17 constituted respectively by a plug that sealably closes one end of duct 15, and by a cylindrical element adjustable in the axial position inside duct 15 that sealably closes the other end of duct 15. A pressure-multiplier piston 18 is slidably mounted inside each reservoir 10. Reservoir bottom 16 formed by the plug extends into each reservoir by an axial stop 19 on which piston 18 rests when reservoir 10 is full. In this position of piston 18, an annular chamber 20 is delimited in reservoir 10 around stop 19. Each chamber 20 communicates with combustion chamber 5 by an inlet channel 21 formed by a duct provided in body 11 of the injection system and in the wall of barrel 1.

Each reservoir 10 also communicates with combustion chamber 5 by an outlet channel 22 provided inside body 11 of the injection system. Each outlet channel 22 is composed of a second blind lengthwise duct 25 adjacent duct 15 in which the associated reservoir 10 is defined, of at least one circumferential duct 26, preferably three, communicating between reservoir 10 and duct 25, and of a radial duct 27 provided in the wall of barrel 1 to place second lengthwise duct 25 and chamber 5 in communication. The free end of each second lengthwise duct 25 terminates at the end face of body 11, which is adjacent to the rear part of barrel 1 of the weapon where breechblock 4 is accommodated.

Figure 3:
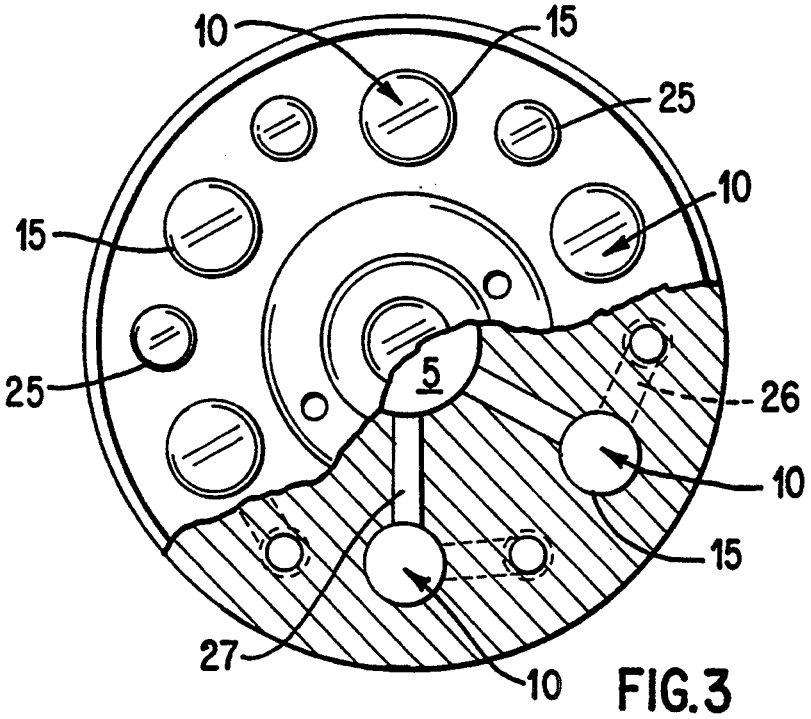
FIG. 3 is a side view of FIG. 1, partially cut away to illustrate the plurality of injection systems.

The first series of lengthwise ducts 15 in which reservoirs 10 are defined and the second series of lengthwise ducts 25 that provide a communication between these reservoirs 10 and chamber 5, are distributed essentially evenly around barrel 1, with ducts 25 being interposed between ducts 15, as can be seen clearly in FIG. 3.

A valve 30 is mounted in each outlet duct 22, which provides communication between a reservoir 10 and chamber 5. In the example considered here, valve 30 is located at the intersection of second blind lengthwise duct 25 and radial duct 27 of each outlet channel 22.

Figure 4:
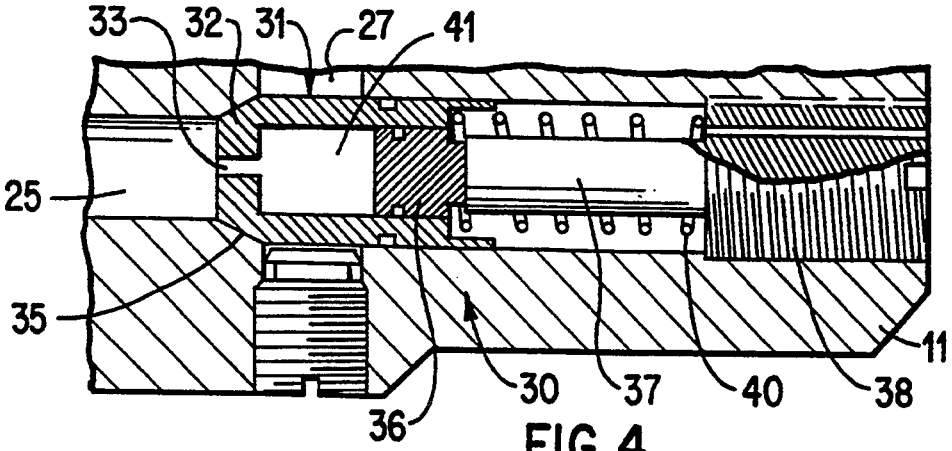
FIGS. 4 and 4*a* are schematic cross sections to illustrate the structure and operating principle of an injection system valve.
Figure 4A:
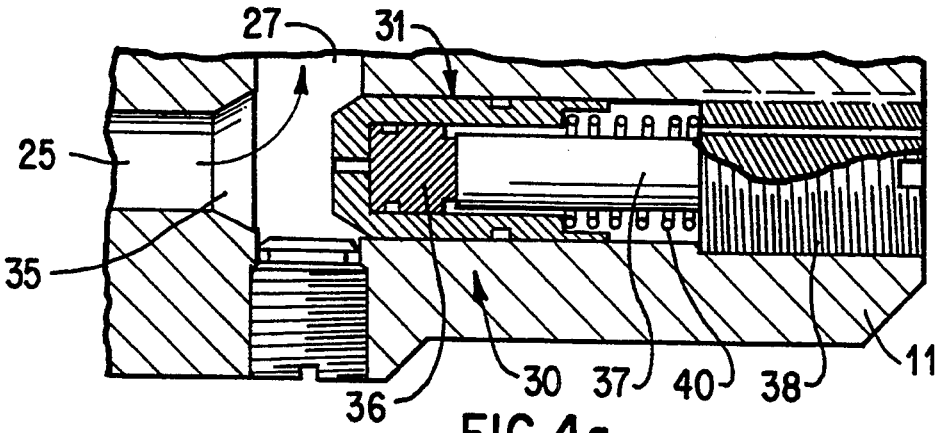

With reference to FIG. 4, each valve 30 comprises an obstructor 31 formed of a tubular element of which one end face or front face is closed by a bottom wall 32, which is provided with a central aperture 33. Obstructor 31 is slidably and sealably mounted in second associated lengthwise duct 25, being introduced thereinto by its front face so that its bottom wall 32 can rest on an annular seat 35 machined in body 11 around the end of lengthwise duct 25, which terminates in radial duct 27.

A piston 36, centered and slidably mounted in a sealed manner inside each obstructor 31, rests on the end of a rod 37, which is the extension of a plug 38 that nonsealably closes the open end of associated blind lengthwise duct 25. A return spring 40 mounted around rod 37 urges each obstructor 31 to rest on its seat 35 in order to close off the passage section between radial duct 27 and lengthwise duct 25.

A variable-volume chamber 41 is thus delimited between bottom wall 32 and piston 36 of each obstructor 31. Thus, when a valve 30 is closed, the propellant agent contained in this second associated lengthwise duct 25 penetrates chamber 41 so that its pressure can be applied to both faces of bottom wall 32 of obstructor 31. Chambers 41 have a cross section smaller than that of second lengthwise ducts 25. As a result, to keep each valve 30 closed, it is sufficient for the force exerted by return spring 40 of each valve 30 to be slightly greater than the difference between the forces exerted simultaneously by the pressure of the propellant agent on both faces of bottom wall 32 of obstructor 31.

The axial position of reservoir bottom 17 of each reservoir 10 is adjusted inside associated duct 15 by a mechanism 50 described hereinbelow. In the example illustrated in FIG. 5, the cylindrical element that forms reservoir bottom 17 is mounted by screwing inside duct 15, with the corresponding threads being symbolized by reference numeral 51. A sleeve 52 is accommodated inside each reservoir bottom 17 and extends over a length shorter than that of the reservoir bottom 17. This sleeve 52 partially projects outside duct 15 and ends in a pinion 53 driven rotationally by a crown 54, itself driven by a drive element not shown. Each reservoir bottom 17 is rotationally integral with sleeve 52 associated by at least one key 55 that engages freely in a lengthwise groove 56 extending along the outer wall of sleeve 52. Damping means 58 are provided inside each reservoir 10 to brake piston 18 at the end of its path. These means 58 are described hereinbelow with reference to FIGS. 5, 5*a*, and 6.

A fixed guide rod 60 is mounted inside sleeve 52 of each reservoir bottom 17. This rod 60 has a generally rectangular cross section so that two arms 61 disposed on either side of rod 60 can slide freely inside sleeve 52. These two arms 61, as they exit sleeve 52, are integral with one end of a support rod 62, which is extended by an axial stop 65, or tip, designed to project more or less inside associated reservoir 10 through reservoir bottom 17. This tip 65 is screwed inside the cylindrical element, which forms each reservoir bottom 17, the corresponding threads being symbolized by reference numeral 63. Threads 63 have a smaller pitch than threads 51 by which reservoir bottom 17 is screwed into associated lengthwise duct 15, and the rectangular cross section of guide rod 60 allows associated tip 65 to be rotationally immobilized.

Thus, when sleeve 52 rotates, the associated reservoir bottom 17 and tip 65 move axially in the same direction, but at different speeds to obtain different displacement lengths, i.e., to obtain a relative displacement between reservoir bottom 17 and tip 65. This being the case, the more the volume of reservoir 10 is increased, the more tip 65 extends inside reservoir 10 and, conversely, the more the reservoir volume 10 is decreased, the more tip 65 retracts.

The end face of each piston 18, which is adjacent to reservoir bottom 17, has a recess 66 designed to fit around tip 65 when piston 18 arrives at the end of its path.

It should be noted that mechanism 50, which adjusts the axial position of reservoir bottom 17, also simultaneously and in perfect synchronism adjusts the length of tip 65, which projects inside reservoir 10.

Finally, reservoir bottom 17 of each reservoir 10 has a reduction in outside diameter allowing it to accommodate at least one end-of-travel damping ring 68 on which rests a sleeve 69 forming a stop, held by a nut 70.

The operation of the injection system according to the invention will now be described.

Figure 5:
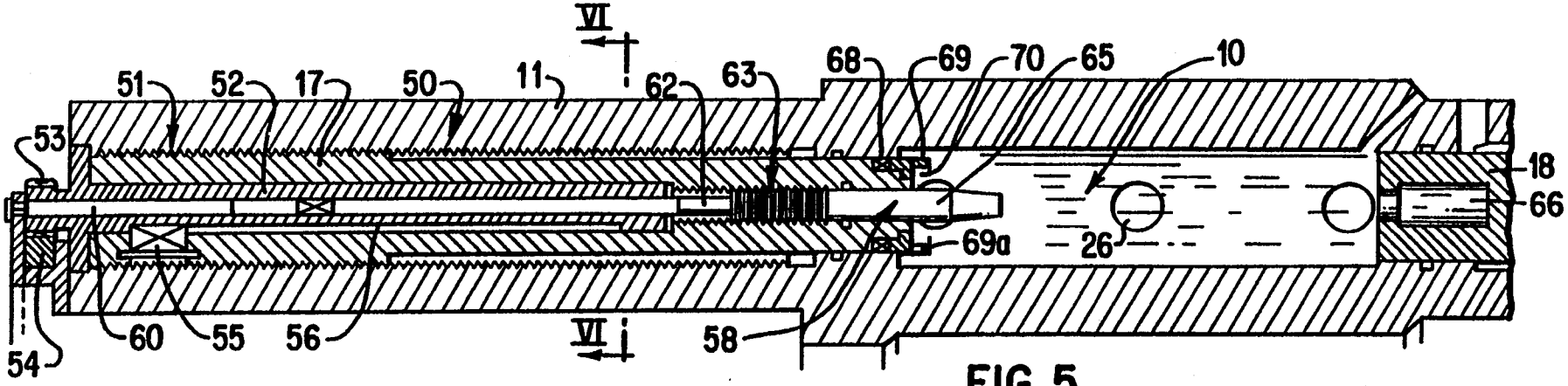
FIGS. 5 and 5*a* are cross-sectional views to illustrate the principle of adjusting the volume of a reservoir of the injection system.
Figure 5A:
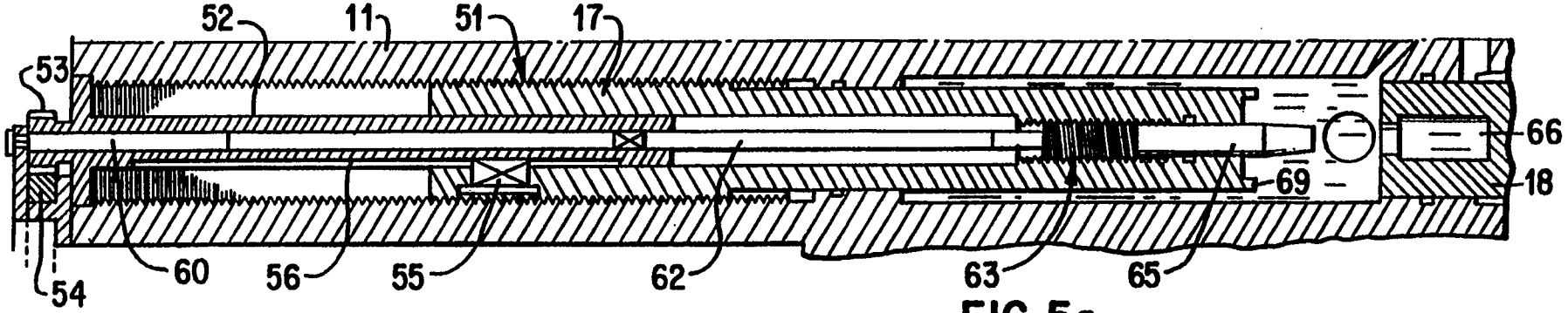
Figure 6:
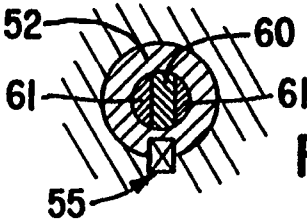
FIG. 6 is a partial cross section along line VI—VI in FIG. 5.

Before projectile 2 loaded into barrel 1 is fired, the volume of each reservoir 10 is adjusted to store the total quantity of propellant agent necessary for firing projectile 2. This operation consists of adjusting the axial position of reservoir bottom 17 of each reservoir 10. With reference to FIGS. 5 and 5*a*, each reservoir bottom 17 can be displaced between a position corresponding to a maximum-volume reservoir (FIG. 5) and a position corresponding to a minimum-volume reservoir (FIG. 5*a*). To bring about this position adjustment, sleeve 52 is driven rotationally by pinion 53 and crown 54. Rotation of sleeve 52 causes displacement of reservoir bottom 17 inside duct 15 in a direction that depends on the rotational direction of sleeve 52. Simultaneously with displacement of reservoir bottom 17, tip 65 moves in the same direction but over a shorter distance. Thus, the more the volume of a reservoir 10 is increased, the more associated tip 65 projects inside reservoir 10, and the opposite when the volume of reservoir 10 is decreased.

Once the volume of each reservoir has been adjusted, the propellant agent is sent under low pressure into all reservoirs 10. For this purpose, each reservoir communicates with the outside via at least one duct 75 (FIGS. 1 and 2) in which a check valve (not shown) is accommodated. As each reservoir 10 is filled, the propellant agent causes each piston 18 to retreat so that it rests on stop 19 when reservoir 10 is full. The propellant agent also spreads into outlet channels 22 and into chambers 41 of obstructors 31 of valves 30. The propellant agent then has insufficient pressure to open valves 30, which thus prevents it from flowing in the direction of combustion chamber 5. Valves 30 are thus in the closed position as the force exerted by return spring 40 on the rear face of obstructor 31 of each valve 30 is greater than the difference between the forces exerted by the propellant agent on the two opposite faces of bottom wall 32 of obstructor 31.

Operation of the injection system begins with an initiation phase, which consists of injecting under pressure a small quantity of propellant agent directly into combustion chamber 5 via a duct 76 machined into the rear part of barrel 1 of the weapon. The propellant agent is then ignited by an electrode 77 for example, which projects inside chamber 5. Once combustion is initiated, gases freely penetrate the interiors of chambers 20 of reservoirs 10 through inlet channels 21, and as soon as their pressure becomes sufficient, they cause displacement of pistons 18. As it moves, each piston 18 compresses the propellant agent contained in reservoir 10 and outlet channel 22, which are in communication. As soon as the propellant agent has reached the necessary pressure to open valves 30, it can then flow continuously into combustion chamber 5, but this pressure is still insufficient for projectile 2 to leave forcing cone 3.

Figure 2:
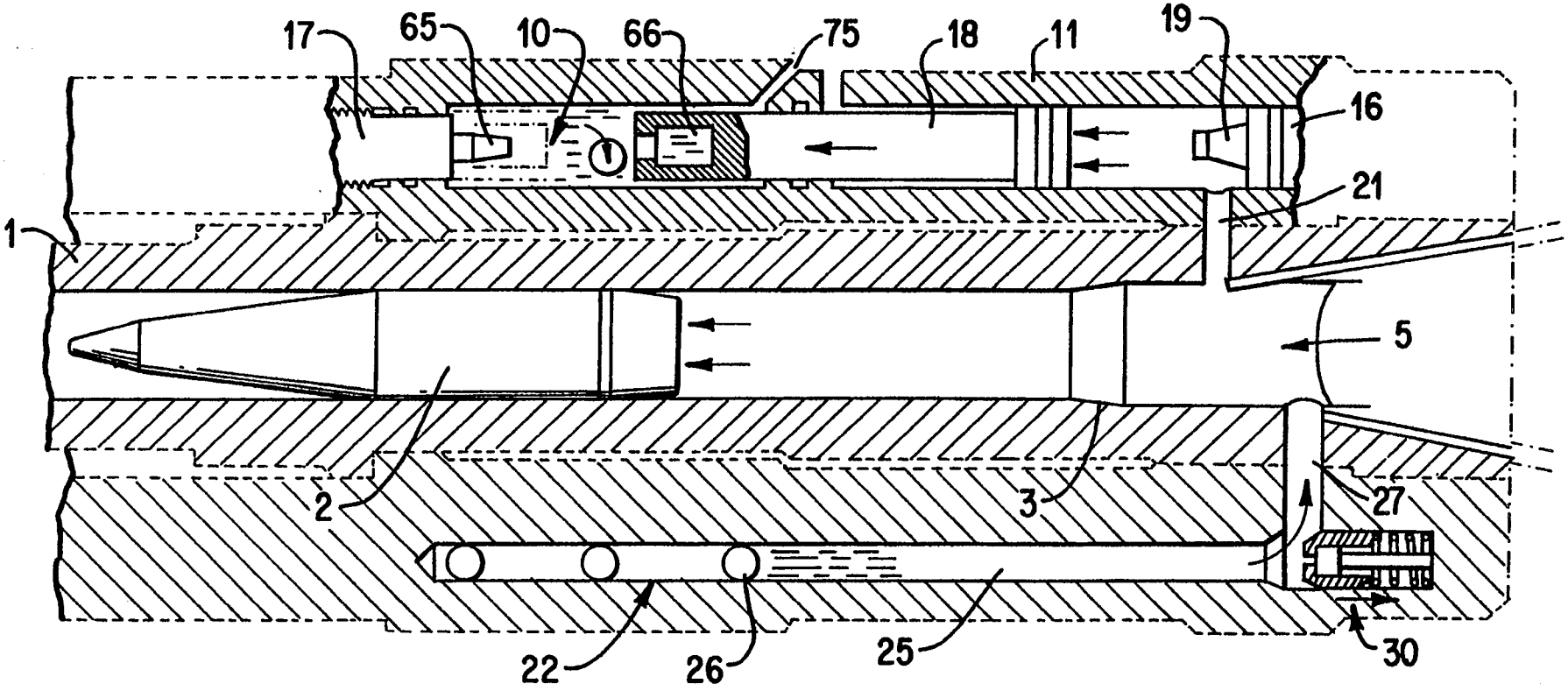
FIG. 2 is a schematic view of FIG. 1 to illustrate the status of the injection system during operation.

Combustion is thus maintained inside chamber 5, and when the gas pressure is sufficient, projectile 2 is ejected, as the volume of the propellant agent stored in reservoirs 10 is calculated for combustion to continue as long as the projectile has not left barrel 1 (FIG. 2).

When each piston 18 arrives at the end of its travel, at a relatively high speed, recess 66 in its front face fits around tip 65 of associated reservoir 10, which causes a lamination effect of the propellant agent contained in recess 66 of piston 18, and slows down piston 18.

At the end of its travel, piston 18 rests on sleeve 69, and its residual energy is absorbed by damping ring 68.

When reservoirs 10 are empty, each piston 18 is essentially in contact with reservoir bottom 17 through sleeve 69. Thus, to initiate the return movement of piston 18, when associated reservoir 10 is filled again, lateral notches 69*a* (FIG. 5) are provided at sleeve 69 so that the propellant agent spreads between piston 18 and reservoir bottom 17. It should be noted that, at the end of the injection, these notches 69*a* favor evacuation of the propellant agent trapped between piston 18 and reservoir bottom 17 of each reservoir 10 to combustion chamber 5.

An annular space E is provided between barrel 1 and body 11 for cooling the weapon.

Of course, the invention is not limited to the embodiment described hereinabove. In particular, the means employed to adjust the volume of each reservoir 10 may be different, as may be the shape and arrangement of the channels connecting each reservoir.

What is claimed is:

1. A liquid-propellant weapon having a system for injecting a liquid propellant agent into a combustion chamber delimited between a projectile loaded in a barrel of the weapon and a breechblock that closes off a rear end of the barrel, wherein the injection system comprises:

a plurality of reservoirs each communicating with the chamber and storing the propellant agent;

a corresponding plurality of pistons each movable inside a respective one of the plurality of reservoirs, said plurality of reservoirs being formed in an annular body mounted around said barrel and each communicating with said chamber by an inlet channel to allow the pressure of said combustion gases to cause displacement of said pistons;

a device that initiates combustion of a small quantity of propellant agent injected directly into the chamber;

at least one outlet channel communicating with said chamber to inject the propellant agent under pressure into said chamber as a result of displacement of said pistons; and at least one pressure-controlled valve accommodated inside said outlet channel to allow passage of the propellant agent when the pressure in at least one of said plurality of reservoirs becomes higher than the pressure in said combustion chamber.

2. A liquid-propellant weapon according to claim 1, wherein said annular body comprises a series of first lengthwise ducts extending parallel to a longitudinal axis of said barrel, said reservoirs being defined inside each of said ducts between two bottom walls constituted respectively by a plug that seals off one end of each of said ducts and by a cylindrical element axially adjustable inside each of said ducts, said cylindrical element sealably closing an opposite end of each of said ducts.

3. A liquid-propellant weapon according to claim 2, wherein said cylindrical elements are threaded inside said first lengthwise ducts and are displaceable axially by a mechanism comprising a fixed sleeve accommodated in each of the cylindrical elements and formed rotationally integral therewith by at least one key that fits freely in a groove of said sleeve, said sleeve being driven rotationally by a driving means activated by a drive element.

4. A liquid-propellant weapon according to claim 3, wherein the injection system further comprises damping means located in each of said reservoirs for damping displacement of a corresponding piston, said damping means comprising an axial stop projecting to a greater or lesser degree inside each of said reservoirs in accordance with the volume thereof, said axial stop shaped to fit into a recess in said piston.

5. A liquid-propellant weapon according to claim 4, wherein said axial stop is threaded inside said reservoir bottom and is integral with a support rod that is axially movable and rotationally immobilized inside a fixed rod disposed inside said sleeve, said axial stop having threads for screwing into said reservoir bottom, said threads having a smaller pitch than threads for attaching said reservoir bottom such that said reservoir bottom and said axial stop move in the same direction but over different displacement distances.

6. A liquid-propellant weapon according to claim 2, wherein a plurality of outlet channels disposed between a respective one of said reservoirs and said chamber are disposed in said body and comprise a corresponding plurality of second lengthwise ducts extending parallel to the longitudinal axis of said barrel, at least one circumferential duct linking each of said reservoirs to said second ducts, and wherein at least one radial linking duct is disposed between said chamber and said second lengthwise ducts.

7. A liquid-propellant weapon according to claim 6, wherein said first lengthwise ducts and said second lengthwise ducts are distributed essentially evenly around said barrel, said second ducts being interposed between said first ducts.

8. A liquid-propellant weapon according to claim 6, wherein said injection system further comprises a plurality of said pressure-controlled valves corresponding to said plurality of reservoirs, each of said valves comprising:

an obstructor formed of a tubular element having a front end face closed by a bottom wall provided with a central aperture, said obstructor being slidably and sealably mounted in a corresponding outlet channel;

an obstructor piston centrally and slidably mounted in a sealed manner inside said obstructor, said obstructor piston resting on a rod extending from a plug closing off one open end of an associated second lengthwise duct; and a return spring urging said bottom wall of said obstructor against an annular seat machined into said body at an intersection of said second duct and said radial linking duct, wherein when said obstructor rests against said annular seat, said second duct is sealed from communicating with said combustion chamber.

9. A liquid-propellant weapon according to claim 8, wherein when said obstructor is resting on said seat, an obstructor chamber is delimited inside said obstructor between said bottom wall and said obstructor piston, said obstructor chamber communicating with an associated second lengthwise duct by said central aperture, said obstructor chamber having a cross section smaller than that of said outlet channel.

10. A liquid-propellant weapon according to claim 9, wherein a return force of said spring necessary for closing said valve is equal to the difference between the forces exerted by the propellant agent on opposite faces of said bottom wall of said obstructor.

11. A liquid-propellant weapon having a system for injecting a liquid propellant agent into a combustion chamber delimited between a projectile loaded in a barrel of the weapon and a breechblock that closes off a rear end of the barrel, wherein the injection system comprises:

an annular body mounted around said barrel; and at least one liquid propellant agent communicating arrangement for injecting said liquid propellant agent into said combustion chamber, said at least one liquid propellant agent communicating arrangement comprising:

a first lengthwise duct disposed in said annular body, said first lengthwise duct comprising a reservoir for storing therein said liquid propellant agent;

means for increasing pressure in said reservoir, said pressure increasing means communicating with said combustion chamber via an inlet duct;

a second lengthwise duct disposed in said annular body, said second lengthwise duct communicating with said reservoir via at least one circumferential duct and in selective communication with said combustion chamber via a radial duct;

a valve disposed between said second lengthwise duct and said radial duct providing said selective communication; and means for adjusting volume of said reservoir thereby enabling storage of a proper quantity of said propellant agent.

12. A liquid-propellant weapon according to claim 11, further comprising a plurality of said liquid propellant agent communicating arrangements disposed in said annular body, wherein said first lengthwise ducts and said second lengthwise ducts are distributed essentially evenly around said barrel, said second ducts being interposed between said first ducts.

13. A liquid-propellant weapon according to claim 11, wherein said valve disposed between said second lengthwise duct and said radial duct comprises:

a tubular shaped obstructor having a bottom wall, said bottom wall closing an end face of said obstructor and comprising a central aperture, said obstructor being slidably and sealingly disposed in said second lengthwise duct, wherein said bottom wall is shaped to sit in an annular seat machined in said annular body;

an obstructor piston slidably and sealingly disposed in said obstructor and fixed to a piston rod; and a return spring disposed around said piston rod, said return spring urging said obstructor to sit in said seat.

14. A liquid-propellant weapon according to claim 11, wherein said pressure increasing means comprises:

a reservoir piston slidably disposed in said reservoir;

a plug sealingly disposed at a first end of said first lengthwise duct;

an axial stop attached to said plug for receiving said reservoir piston; and an annular chamber delimited by said reservoir piston and a surface of said stop, said annular chamber communicating with said combustion chamber via said inlet duct.

15. A liquid-propellant weapon according to claim 11, wherein said reservoir is defined in said first lengthwise duct by a plug sealingly disposed at a first end of said first lengthwise duct and by a cylindrical element adjustable along a longitudinal axis of said first lengthwise duct sealingly disposed at a second end of said first lengthwise duct.

16. A liquid-propellant weapon according to claim 12, wherein said cylindrical element is threadedly disposed in said first lengthwise duct, said cylindrical element comprising a sleeve nonrotatably disposed in said cylindrical element and having a projecting portion projecting outside of said first lengthwise duct, said projecting portion being connected to a driving means.

17. A liquid-propellant weapon according to claim 15, wherein a guide rod and two guide arms are slidably disposed in said sleeve, said two guide arms being integral with a first end of a support rod, wherein an axial stop is threadedly attached to a second end of said support rod, the threads between said support rod and said axial stop having a smaller pitch than the threads between said cylindrical element and said first lengthwise duct, wherein said cylindrical element, sleeve, driving means, guide rod, two guide arms, support rod and axial stop comprise said volume adjusting means.

* * * * *